United States Patent [19]

Livesay

[11] 4,227,744

[45] Oct. 14, 1980

[54] IMPACT TIP FOR IMPACT ROCK BREAKER

[75] Inventor: Richard E. Livesay, Peoria, Ill.

[73] Assignee: Caterpillar Tractor Co., Peoria, Ill.

[21] Appl. No.: 11,600

[22] Filed: Jan. 29, 1979

[51] Int. Cl.[2] ..... A01B 23/02; E21C 35/18

[52] U.S. Cl. ..... 299/94; 299/91; 37/142 R; 172/713

[58] Field of Search ..... 299/36, 37, 91, 94; 37/141 T, 142 R, 142 A; 172/713

[56] References Cited

U.S. PATENT DOCUMENTS

| | | | |
|---|---|---|---|
| 2,752,702 | 7/1956 | Nelson | 37/142 R |
| 3,326,302 | 6/1967 | Washbond et al. | 172/713 |
| 3,444,633 | 5/1969 | Hensley | 299/91 X |
| 3,623,247 | 1/1970 | Stepe | 37/142 R |
| 3,770,322 | 4/1971 | Cobb et al. | 299/37 |
| 3,922,017 | 12/1974 | Cobb | 299/70 |
| 4,027,408 | 6/1977 | Ramella et al. | 37/142 R X |
| 4,068,742 | 9/1976 | Resare | 181/1 B |

*Primary Examiner*—Ernest R. Purser

*Attorney, Agent, or Firm*—Wegner, Stellman, McCord, Wiles & Wood

[57] ABSTRACT

A detachable impact tip (10) for an impact rock breaker (B) has a mounting socket (11) and an improved tooth (12) which has a rectangular base (13) abutting the socket (11), and a body (14) which is wedge-shaped in side elevation and generally spade-shaped in plan. The body (14) has smoothly rounded longitudinal margins (17), and an extremity (15) which forms a generally blunt edge smoothly rounded from top to bottom and gently convex from side to side, and smoothly curved forward margins (18) between generally triangular sides (14a) of the body (14) and said extremity (15).

8 Claims, 8 Drawing Figures

FIG. 4
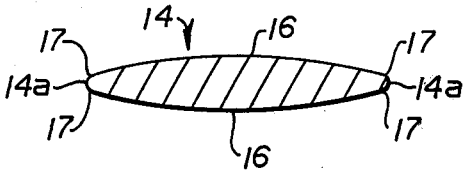
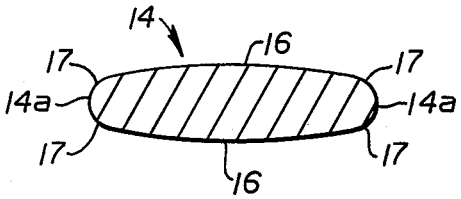
FIG. 5
FIG. 6
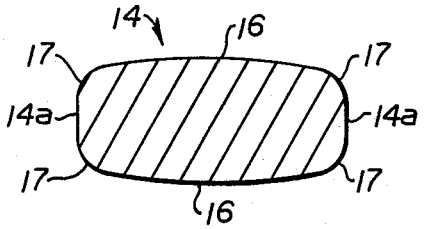
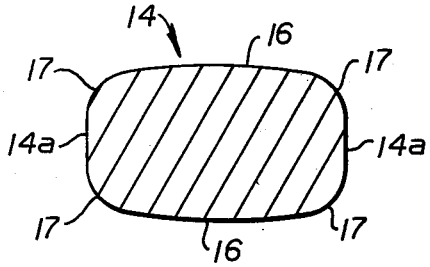
FIG. 7
FIG. 8
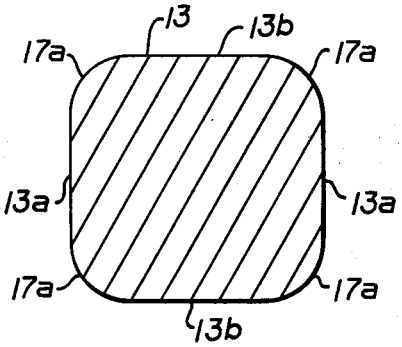

IMPACT TIP FOR IMPACT ROCK BREAKER

DESCRIPTION

1. Technical Field

This invention relates to a removable impact tip which mounts on a shank of an impact material fracturing apparatus, or rock breaker.

2. Background Art

Impact tips for material fracturing devices, which are commonly called rock breakers, are subjected to enormous stresses in use, so that they ordinarily have a rather short useful life. Careful selection of materials for maximum impact resistance has produced marked improvements in these devices; but even with the best available materials the useful life of the impact tips is undesirably brief.

The use to which impact tips are put is so different from that of devices such as bucket teeth, excavator teeth, or trencher teeth that the experience with such teeth is quite useless in engineering an improved impact tip for an impact rock breaker.

Typical tip structures for impact rock breakers are seen in U.S. Pat. Nos. 3,770,322; 3,922,017; and 4,068,742.

DISCLOSURE OF INVENTION

The present invention is directed to providing a replaceable impact tip for an impact rock breaker which has a longer service life than do the impact tips of the prior art.

According to the present invention, a detachable impact tip for an impact rock breaker includes a mounting socket adapted for fixed attachment to a breaker shank, and a rock impacting tooth of improved shape which is integral with the socket. The tooth has a base abutting the socket, and a body on the base which is wedge-shaped in side elevation and generally spade-shaped in plan, the body having smoothly rounded longitudinal margins, an extremity which forms a blunt edge smoothly rounded from top to bottom and gently convex from side to side, and smoothly curved forward margins between generally triangular sides of the body and the extremity forming the blunt edge.

BRIEF DESCRIPTION OF DRAWINGS

FIGS. 4–8 are transverse sectional views taken, respectively, as indicated along the lines IV—IV, V—V, VI—VI, VII—VII, and VIII—VIII of FIG. 2.

BEST MODE FOR CARRYING OUT THE INVENTION

Figure 1:
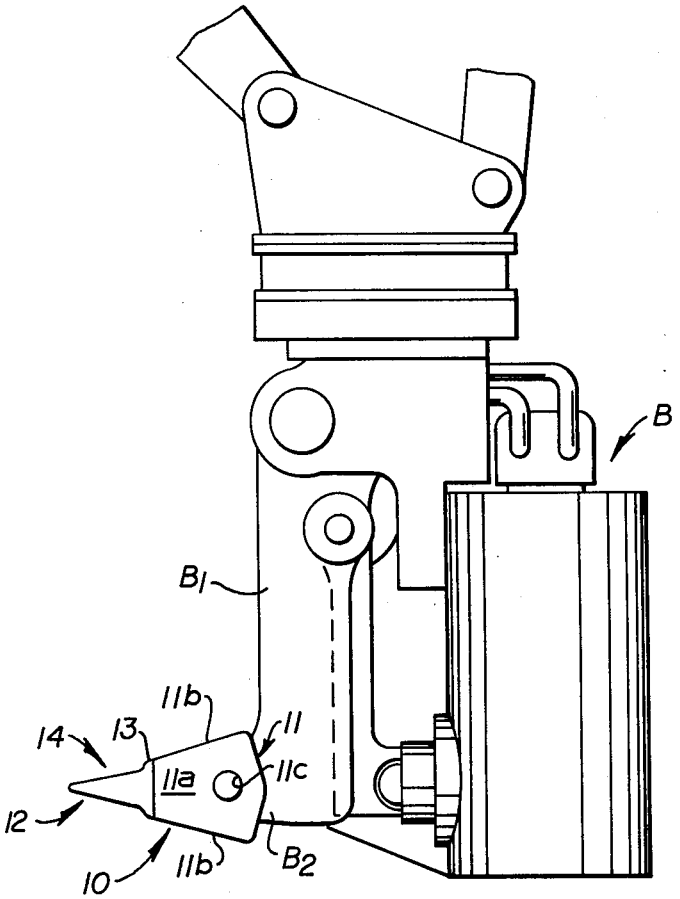
FIG. 1 is a fragmentary side elevational view of an impact rock breaker provided with a detachable impact tip embodying the present invention.
Figure 2:
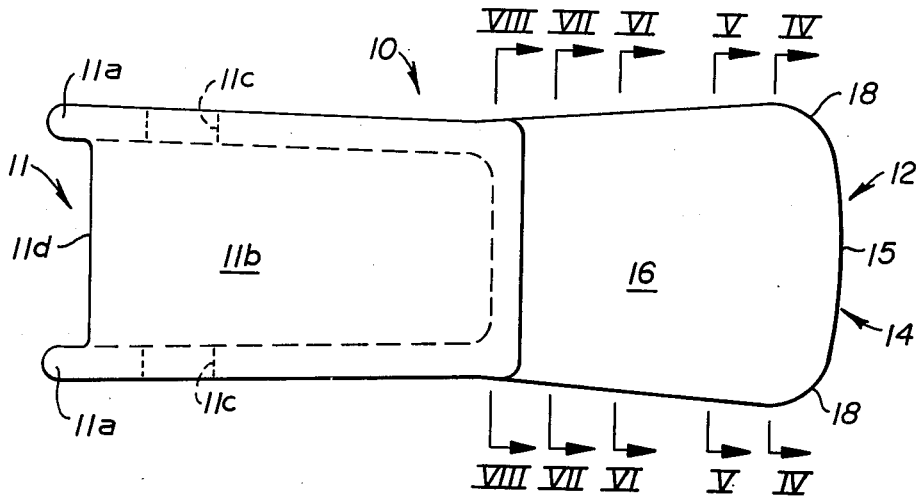
FIG. 2 is a plan view of the detachable impact tip of the present invention.
Figure 3:
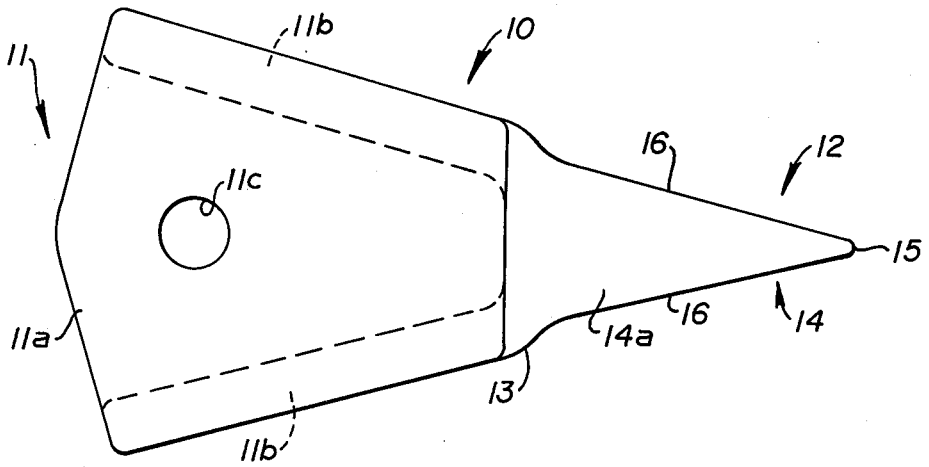
FIG. 3 is a side elevational view of the detachable impact tip of the present invention.

Referring to FIG. 1 of the drawings, an impact rock breaker, indicated generally at B, may, for exemplary purposes, be of the type disclosed in U.S. Pat. No. 3,922,017, so that it has a breaker shank B1, the lower end portion B2 of which is adapted to receive the detachable impact tip 10 of the present invention. The impact tip 10 consists generally of a mounting socket 11 having side walls 11*a* and top and bottom walls 11*b*. Aligned apertures 11*c* in the side walls 11*a* receive a mounting pin which detachably secures the impact tip 10 to the extremity B2 of the breaker shank B1. The impact tip 10 also includes a tooth 12 which includes a base 13 abutting the socket 11 and a body 14 on the base 13. As seen in FIGS. 2 and 3, the body is wedge-shaped in side elevation and generally spade-shaped in plan.

The body 14 has effectively smooth surfaced, substantially triangular lateral faces 14*a* which extend from the base 13 toward a tooth extremity 15, and it also has effectively smooth surfaced top and bottom faces 16 which extend from the base 13 to the tooth extremity 15, and which are gently convexly curved in cross section throughout their lengths as seen in FIGS. 4–7. The substantially triangular lateral faces 14*a* are connected to the top and bottom faces 16 by smoothly rounded longitudinal margins 17 which are seen in FIGS. 4–7; and a comparison of FIGS. 6 and 7 with FIGS. 4 and 5 shows that the generally triangular sides 14*a* of the body 14 gradually vanish into the smoothly rounded top and bottom margins 17 about midway between the base 13 and smoothly curved forward margins 18 which are between the generally triangular sides 14*a* and the extremity 15. As seen in FIGS. 2 and 3, the extremity 15 forms a blunt edge which is smoothly rounded from top to bottom and gently convex from side to side so as to merge smoothly into the curved forward margins 18.

The base 13 is seen in FIG. 8 to be generally square in cross section, with substantially planar side surfaces 13*a* and top and bottom surfaces 13*b* which are connected by smoothly rounded top and bottom margins 17*a* that merge into the smoothly rounded longitudinal margins 17 of the body 14.

As seen in FIG. 2, the top and bottom faces 16 of the body 14 are wider at the curved forward margins 18 than they are at the base 13.

Thus, the tooth may be described as having top, bottom and side surfaces which join at a leading edge that has a large radius center portion and smaller radius lateral extremities with the top and bottom surfaces diverging from the base 13 toward the small radius extremities 18 of the leading edge.

Likewise, the top and bottom surfaces have a large radius and join the side surfaces along curves of relatively small radius which constantly decrease from the base 13 into the leading edge 15. Thus the entire surface of the body 14 is devoid of any abrupt transitions from one area to another except between the top and bottom surfaces 16 at and immediately adjacent the forward extremity 15.

A typical impact tip embodying the invention has the following dimensions and radii of curvature, the "h" and "w" dimensions being, respectively, the vertical dimensions and horizontal dimensions of the corespondingly numbered sectional views, and "r" being the radius of curvature of the curve 17*a* or the longitudinal curve 17.

$4h=0.666''$; $4w=4.00''$; $4r=0.12''$
$5h=1.07''$; $5w=3.86''$; $5r=0.36''$
$6h=1.68''$; $6w=3.60''$; $6r=0.50''$
$7h=2.10''$; $7w=3.50''$; $7r=0.62''$
$8h=3.20''$; $8w=3.40''$; $8r=0.75''$

The radii of curvature of the surfaces 16 are 8.00" throughout; the top-to-bottom radius of curvature at 15 is 0.12"; the transverse radius of curvature at 15 is 7.00"; the radius of curvature at 18 is 0.80"; and the radius of curvature at 13 is 1.12".

The length from lld to line VIII—VIII is 5.19". The distance from the various section lines to the extremity 15 is: from VIII—VIII 4.68"; from VII—VII 3.87"; from VI—VI 3.00"; from V—V 1.75"; from IV—IV 0.91".

The foregoing dimensions would, of course, vary proportionally for impact tips to be used with larger or smaller impact rock breaker machines.

INDUSTRIAL APPLICABILITY

In use, the detachable impact tip 10 of the present invention is mounted upon a breaker shank B1 of an impact rock breaker B. The particular shape of the body 14 which is disclosed and claimed herein, and the way in which it merges into the base 13, provides greatly improved tip life as compared with tips heretofore available.

Other aspects, objects and advantages of the invention can be obtained from a study of the drawings, the disclosure and the appended claims.

I claim:

1. In a detachable impact tip (10) for an impact rock breaker (B) which includes a mounting socket (11) adapted for fixed attachment to a breaker shank (B1, and a rock impacting tooth (12) integral with said socket (11), a tooth (12) comprising:

a base (13) abutting the socket (11);

and a body (14) on said base (13) which is wedge-shaped in side elevation so that it has generally triangular sides 14*a*, and which is generally spade-shaped in plan with top and bottom surfaces (16) and a forward extremity (15), said body (14) has smoothly rounded top and bottom longitudinal margins 17 which have progressively smaller radii of curvature toward said forward extremity (15), said generally triangular sides (14*a*) of the body (14) merge progressively into said smoothly rounded top and bottom longitudinal margins (17) toward said forward extremity (15) and vanish rearwardly thereof, said forward extremity (15) forms a blunt edge smoothly rounded from top to bottom, and smoothly curved forward margins (18) between said longitudinal margins (17) and said extremity (15), and said body (14) is devoid of any abrupt transitions from one area to another except between the top and bottom surfaces (16) at and immediately adjacent the forward extremity (15).

2. The tooth of claim 1 in which the body (14) has top and bottom faces (16) which are wider at the curved forward margins (18) than at the base (13).

3. The tooth of claim 2 in which the base (13) has substantially planar side (13*a*) and top and bottom (13*b*) surfaces connected by smoothly rounded top and bottom margins (17*a*) which merge into the smoothly rounded longitudinal margins (17) of the body (14).

4. The tooth of claim 3 in which the generally triangular sides (14*a*) of the body (14) vanish into the smoothly rounded top and bottom margins (17) about midway between the base (13) and the smoothly curved forward margins (18).

5. The tooth of claim 1 in which the base (13) has substantially planar side (13*a*) and top and bottom (13*b*) surfaces connected by smoothly rounded top and bottom margins (17*a*) which merge into the smoothly rounded longitudinal margins (17) of the body (14).

6. The tooth of claim 5 in which the generally triangular sides (14*a*) of the body (14) vanish into the smoothly rounded top and bottom margins (17) about midway between the base (13) and the smoothly curved forward margins (18).

7. The tooth of claim 1 in which the generally triangular sides (14*a*) of the body (14) vanish into the smoothly rounded top and bottom margins (17) about midway between the base (13) and the smoothly curved forward margins (18).

8. In a detachable impact tip (10) for an impact rock breaker (B) which includes a mounting socket (11) adapted for fixed attachment to a breaker shank (B1), and a rock impacting tooth (12) integral with said socket (11), a tooth (12) comprising:

a base (13) abutting the socket (11);

effectively smooth surfaced, substantially triangular lateral faces (14*a*) which extend from said base (13) toward a forward extremity (15);

effectively smooth surfaced top and bottom faces (16) which extend from said base (13) to said tooth extremity (15) and which are gently convexly curved in cross section throughout their lengths;

smoothly rounded longitudinal margins (17) between said lateral faces (14*a*) and said top and bottom faces (16), said longitudinal margins (17) having progressively smaller radii of curvature toward said forward extremity (15);

and smoothly curved forward margins (18) connecting said longitudinal margins (17) with said forward extremity (15), said forward extremity (15) being a blunt edge smoothly rounded from top to bottom and gently convex from side to side on a radius of curvature which is several times that of said forward margins (18), and said body (14) being devoid of any abrupt transitions from one area to another except between the top and bottom surfaces (16) at and immediately adjacent the forward extremity (15).

9. The tooth of claim 8 in which the lateral faces (14*a*) of the body (14) merge progressively into said smoothly rounded top and bottom longitudinal margins (17) toward said forward extremity (15) and vanish rearwardly thereof.

* * * * *